US005986409A

United States Patent [19]

Farnworth et al.

[11] Patent Number: 5,986,409

[45] Date of Patent: Nov. 16, 1999

[54] FLAT PANEL DISPLAY AND METHOD OF ITS MANUFACTURE

[75] Inventors: Warren M. Farnworth, Nampa; Kevin Duesman, Boise, both of Id.

[73] Assignee: Micron Technology, Inc., Boise, Id.

[21] Appl. No.: 09/049,999

[22] Filed: Mar. 30, 1998

[51] Int. Cl.[6] ..... G09G 3/10

[52] U.S. Cl. ..... 315/169.4; 345/84; 345/37; 313/496

[58] Field of Search ..... 315/169.4, 169.2; 345/37, 41, 42, 60, 63, 84; 313/496, 587; 445/24, 51

[56] References Cited

U.S. PATENT DOCUMENTS

| | | | |
|---|---|---|---|
| 5,210,472 | 5/1993 | Casper et al. | 315/349 |
| 5,634,836 | 6/1997 | Lepselter | 445/24 |
| 5,654,727 | 8/1997 | Lepselter | 345/60 |
| 5,686,790 | 11/1997 | Curtin et al. | 313/493 |
| 5,705,079 | 1/1998 | Elledge | 216/24 |
| 5,706,020 | 1/1998 | Iwama | 345/60 |
| 5,708,325 | 1/1998 | Anderson et al. | 313/495 |

*Primary Examiner*—Don Wong
*Assistant Examiner*—Haissa Philogene
*Attorney, Agent, or Firm*—Dickstein Shapiro Morin & Oshinsky LLP

[57] ABSTRACT

The present invention relates to a gas discharge flat panel display created out of a substrate and a glass sheet. Light generating phosphors are disposed upon a plane surface of the glass sheet. The substrate contains pits matching the locations of the disposed phosphors, each pit containing upstanding firing points connected to conductive traces. The conductive traces are used to generate a high electric field at the firing points. The glass sheet is located over the substrate and a gas at or near atmospheric pressure is trapped in the pits between the glass and the substrate. The gas ionizes when the firing points are electrified and the energy given off by the gas excites the phosphors giving off light.

83 Claims, 4 Drawing Sheets

FLAT PANEL DISPLAY AND METHOD OF ITS MANUFACTURE

FIELD OF THE INVENTION

This invention relates to a flat panel display device and a method for making the same and, in particular, to a flat panel color display operable with gases at substantially atmospheric pressure.

BACKGROUND OF THE INVENTION

Cathode ray tube (CRT) displays are commonly used in display devices such as televisions and desk-top computer screens. CRT displays operate as a result of a scanning electron beam from an electron gun striking phosphors resident on a distant screen. The electrons increase the energy level of the phosphors. When the phosphors return to their original energy level, they release photons which are transmitted through the display screen (normally glass) forming a visual image to a person looking at the screen. A colored CRT display utilizes an array of display pixels wherein each individual display pixel is comprised of a trio of color generating phosphors (that is, each pixel is split into three colored parts, which alone or in combination create colors when activated). Color images are created by exciting the appropriate colored phosphors.

Flat panel displays are becoming more popular in today's society. These displays are being used more frequently, particularly to display the information of computer systems and other devices. Typically, flat panel displays are lighter and utilize less power than conventional CRT display devices.

There are different types of flat panel displays. One type of flat panel display is known as a cold cathode field emission display (FED). Cold cathode FED's are similar to CRT displays in that they use electrons to illuminate a cathodoluminescent screen. The electron gun is replaced with numerous (at least one per display pixel) emitter sites. When activated by a high voltage, the emitter sites release electrons which strike the display screen's phosphor coating. As in CRT displays, the phosphor releases photons which are transmitted through the display screen (normally glass) forming a visual image to a person looking at the screen. A colored FED display utilizes an array of display pixels wherein each individual display pixel is comprised of a trio of color generating phosphors (that is, each pixel is split into three colored parts which alone, or in combination create colors when activated). Color images are created by exciting the appropriate colored phosphors.

In order to obtain proper operation of the flat panel display, it is extremely important for a FED of the cold cathode type to maintain an evacuated cavity between the emitter sites (acting as a cathode) and the display screen (acting as a corresponding anode). The typical cold cathode FED is evacuated to a pressure of $10^{-6}$ Torr or less. This reduced atmospheric pressure is required to allow electron emission. In addition, since there is a high voltage differential between the screen and the emitter sites, the reduced pressure is also required to prevent an electrical breakdown.

The reduced atmospheric pressure presents several problems. Firstly, the spacing between the emitter sites and the screen must be uniform and narrow to retain high resolution images and requisite thinness of the FED. Uneven spacing is likely due to the high pressure differential existing between the external atmosphere and the pressure within the evacuated cavity of the FED. This spacing problem worsens as the display screen gets larger. In addition, the reduced pressure places a tremendous atmospheric load on the FED's screen. This load may cause the screen to warp. Therefore, cold cathode FEDs require additional structure (such as spacers or thicker components) to prevent these problems.

Another popular flat panel display is a plasma based or gas discharged display. Plasma based flat panel displays generally utilize an enclosed gas or gas mixture in a partially evacuated cavity. Crossed conductors (acting as opposed electrodes) are placed within the cavity to break down the gas into a plasma of electrons and ions causing a visible glow. In a monochrome monitor, a light emitting gas, such as neon, or light generating phosphors are used to generate visual images. Generally, each display pixel has at least one corresponding crossing point.

A colored plasma display utilizes an array of display pixels wherein each individual display pixel is comprised of a trio of color generating phosphors (that is, each pixel is split into three colored parts, which alone or in combination create colors when activated). Accordingly, the colored display pixel would have three crossing points corresponding to each color generating phosphor. Color images are created by exciting the appropriate color generating phosphors.

In order to obtain proper operation of the gas discharged flat panel display, it is extremely important that a partial vacuum be maintained within the cavity containing the crossed conductors and the gas. The partial vacuum is required to maintain the minimum firing voltage of the gas disposed within the cavity (according to Paschen's Law, the minimum firing voltage of a gas is a product of the gas pressure and the distance between the electrical conductors).

As with cold cathode FEDs, the reduced pressure inside the gas discharge display presents several problems. For example, reduced pressure places a large atmospheric load (approximately 15 pounds per square inch) on the screen. Special manufacturing techniques are required to alleviate the implosive forces exerted on the display. Secondly, rare gases must be used in order to achieve the requisite breakdown into plasma presenting additional manufacturing difficulties. These troubles have made it difficult to use high resolution plasma based displays in computer workstations.

Attempts have been made to correct the shortcomings of the flat panel display. For example, U.S. Pat. No. 5,654,727 (Lepselter) discloses a gas discharge flat panel display operable at substantially atmospheric pressure. The disclosed apparatus utilizes a first set of conductors spaced apart at a precise distance from a second set of conductors in a crossed pattern. The cross points of the conductors are used to energize a gas held at a precise pressure in order to give off a light emissive discharge. The disclosed apparatus utilizes an additional layer of substrate, which is then sacrificially discarded, to maintain the required spacing between the crossed conductors.

Although advances have been made, prior art flat panel displays often require additional, or intermediate, layers of substrate or additional structures to maintain precise spacing or pressure. In addition, flat panel displays often require special gases, high vacuums or high power. Accordingly, a low powered flat panel display containing a confined gas which is nearer to atmospheric pressure and has a simplified manufacturing process is still needed.

SUMMARY OF THE INVENTION

This present invention provides a low powered gas discharge flat panel display which has confined gasses at, or near to, atmospheric pressure.

The invention also provides a gas discharge flat panel display having increased intensity and resolution levels and which is easily manufactured.

The gas discharge flat panel display of the invention achieves these features and advantages and others by forming a gas discharge flat panel display out of a substrate and a glass sheet. Light generating phosphors are disposed upon a plane surface of the glass sheet. The substrate contains pits matching the locations of the disposed phosphor, each pit containing firing points connected to conductive traces. The conductive traces are used to generate a high electric field at the firing points. The glass sheet is located over the substrate and a gas at or near atmospheric pressure is trapped in the pits between the glass and the substrate. The gas ionizes when the firing points are electrified and the energy given off by the gas excites the phosphor giving off light.

A colored gas discharge flat panel display will utilize an array of display pixels wherein each individual display pixel is comprised of a trio of color generating phosphors; the substrate contains pits matching the locations of each individual color generating phosphor, each pit containing firing points connected to conductive traces. Color images are created by exciting the appropriate phosphors. In other embodiments, colored filter elements may replace the light generating phosphors. The light given off by the gas illuminates through the filters.

BRIEF DESCRIPTION OF THE DRAWINGS

The foregoing and other objects and advantages of the invention will become more apparent from the detailed description of the preferred embodiments of the invention given below with reference to the accompanying drawings in which.

DETAILED DESCRIPTION OF THE PREFERRED EMBODIMENTS

Figure 1:
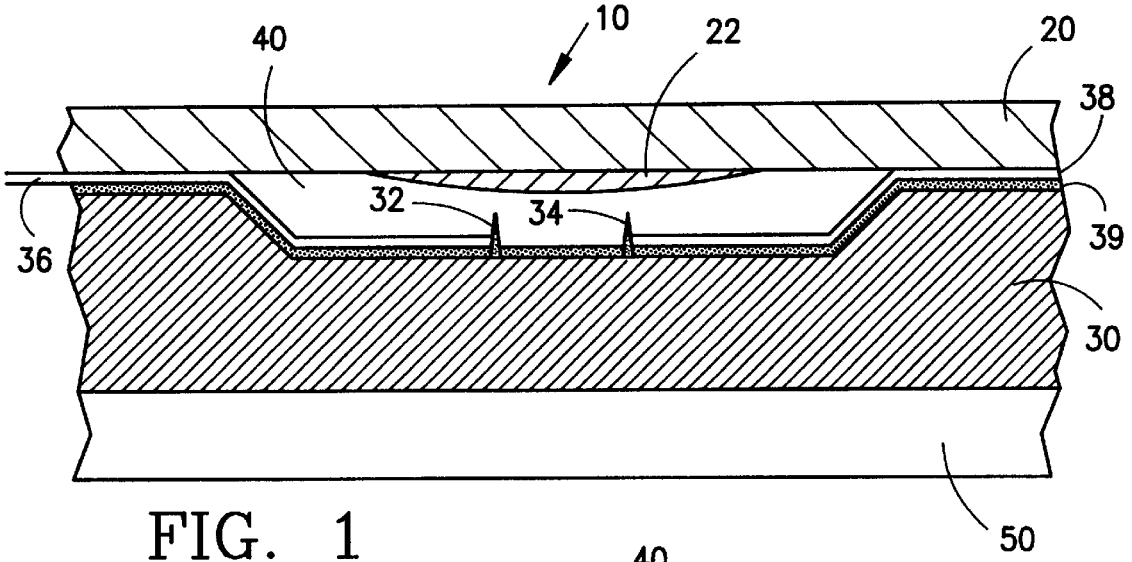
FIG. 1 is a cross-sectional view of a portion of a flat panel display constructed according to a first embodiment of the present invention.

FIG. 1, illustrates a portion of a flat panel display 10 constructed in accordance with the present invention. The flat panel display 10 is fabricated from a glass plate 20 and a substrate 30. An additional mechanical supporting substrate 50 may also be used to strengthen the completed flat panel display 10. The manufacturing process of the display 10 is described in detail below.

As shown, a light generating phosphor dot 22 is disposed upon the bottom surface of the glass plate 20. The terms "dot" and "dots" will be used to represent any form that the phosphor takes once disposed upon the glass plate 20 (for example, circular, elliptical, triangular, rectangular, square, etc.) and is not to be limited to a purely circular formation. In a preferred embodiment of the invention numerous phosphor dots 22 are disposed upon the glass plate 20 in rows and columns; each dot 22 corresponding to a pixel of the flat panel display 10. The number of pixels, and corresponding phosphor dots 22, coincides with the desired resolution of the display 10.

If a color image is desired, a trio of colored light generating phosphor dots 22 would be used per individual pixel (that is, each pixel is split into three colored parts, which alone or in combination create colors when activated); each trio having individual red, blue and green colors. Accordingly, for every display pixel in a colored display 10, there will be a red light generating phosphor dot 22, a blue light generating phosphor dot 22, and a green light generating phosphor dot 22 disposed upon the glass plate 20. For convenience of discussion, reference will be made only to the portion of the display 10 illustrated in the figures.

Substrate 30 is preferably made out of a single crystal silicon. Alternatively, amorphous silicon deposited on an underlying layer comprised largely of glass or other combination may be used as long as a material capable of conducting electrical current is present on the substrate 30. The need for the substrate 30 to be non-conductive is so that operable firing points 32, 34 can be formed on the substrate 30 as discussed below. The substrate 30 may be a single piece of silicon or several pieces connected together. Moreover, any material with etching characteristics similar to that of silicon may be used as the substrate 30.

A pit 40 is formed within the substrate 30. In a preferred embodiment, the pit 40 is micro-machined as described in detail below. Two firing points 32, 34 are located on the substrate 30 within the pit 40. It must be noted that more than two firing points may be used and the invention is not to be so limited. For convenience the remaining detailed description of this embodiment, as well as other embodiments described below, will refer to two firing points 32, 34. Any description referring to two firing points 32, 34 or connections to or operation thereof is applicable to two or more firing points.

Figure 2:
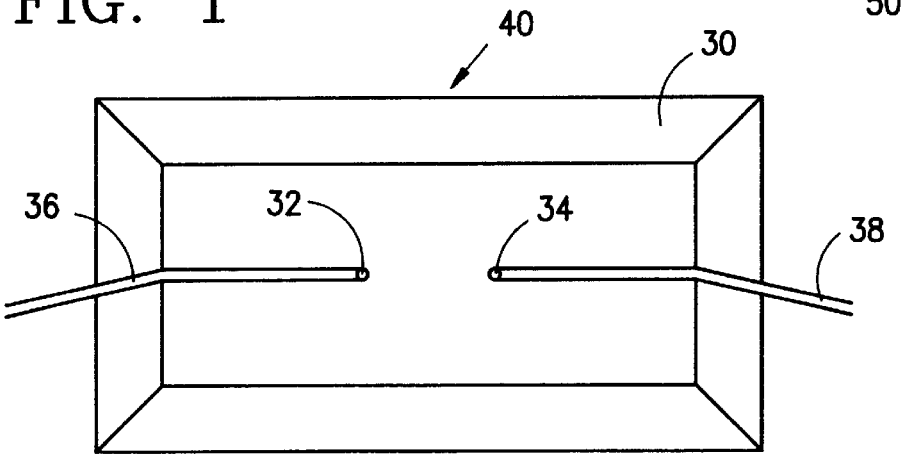
FIG. 2 is a top detailed view of a substrate pit containing firing tips and conductive traces of a flat panel display constructed according to the first embodiment of the present invention.

The firing points 32, 34 are etched out of the same material as the substrate 30 and have sharp pointed tips. The spacing between the firing points 32, 34 can range from ten to twenty-five microns. The height of the firing point 32, 34 can range from three to seven microns. The spacing and formation of the firing points 32, 34 is described below. As shown in FIG. 2, a first conductive trace 36 is connected to the first firing point 32 while a second conductive trace 38 is connected to the second firing point 34. The traces 36, 38 are patterned to extend from the pit 40 to the edge of the substrate 30. It is convenient for purposes of discussion only, to assume that the first conductive trace 36 is externally activated by electronic circuitry to serve as a cathode while the second conductive trace 38 is activated to serve as an anode. The substrate 30 also contains an insulating layer 39 underneath the conductive traces 36, 38 to prevent short circuits between the substrate 30 and the traces 36, 38.

The firing points 32, 34 have sharp pointed tips and are spaced close to each other. As noted, the spacing between the firing points 32, 34 can range from ten to twenty-five microns, although approximately thirteen microns is preferred. The height of the firing point 32, 34 can range from three to seven microns, and is preferably approximately five microns. Generally, it takes 10,000 volts for electrons to jump a 0.25 inch gap at standard temperature and pressure (STP) in dry air. Since the firing points 32, 34 are close to each other and very sharp, a much lower voltage (approximately 200 to 300 volts) is required. The firing points 32, 34 create a high "effective" field, causing electron movement, out of the low voltage applied through the conductive traces 36, 38. In addition, the "effective" field can be produced with a gas which is at or near atmospheric pressure. Operation at or near atmospheric pressure provides an increase in plasma discharge speed and a corresponding increase in persistence (sometime referred to as sustain frequency) and, accordingly, an increase in brightness.

Referring again to FIG. 1, the glass plate 20 is placed over and mated to the substrate 30 such that the phosphor dot 22 aligns with the pit 40. A gas (not shown) is then disposed within the pit 40. In a preferred embodiment, the gas is air. By using air, the flat panel display 10 is maintained at or near substantially atmospheric pressure causing the display to be free of implosive forces.

Essentially, the gas ionizes when a voltage is applied to the firing points 32, 34 through the conductive traces 36, 38. The mechanism for driving the traces 36, 38 with a suitable voltage will be described below. The energy given off by the gas excites the phosphor dot 22. The excited phosphor dot 22 gives off light in its characteristic frequency forming a visual image on the flat panel display 10. The pits 40, cause the energy given off by the gas to be trapped within the pits 40 to thereby prevent the excitation of other nearby phosphor dots 22.

Figure 3:
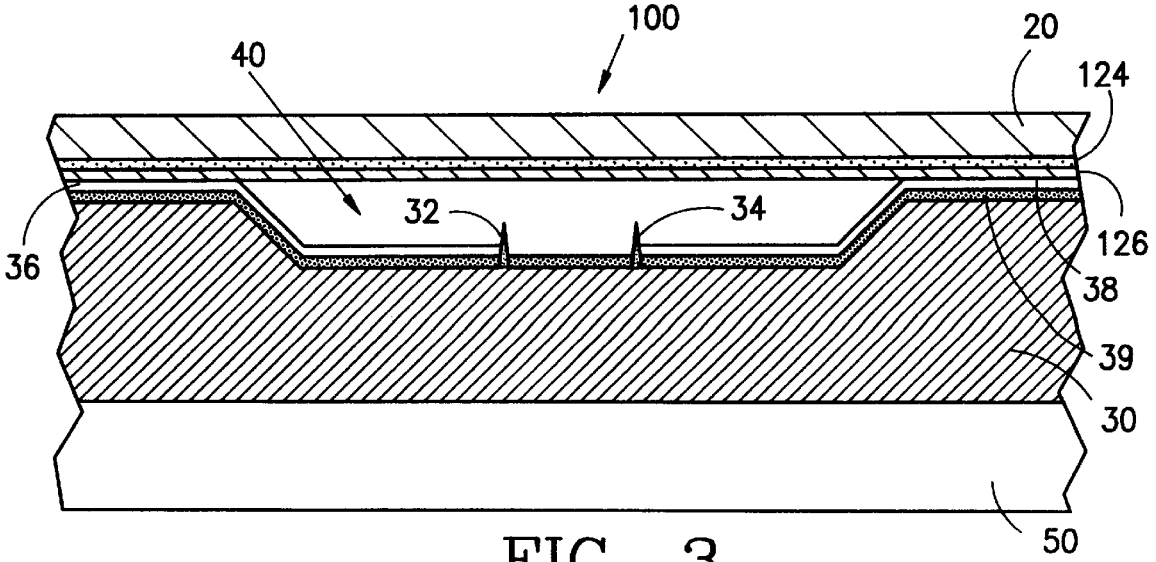
FIG. 3 is a cross-sectional view of a portion of a flat panel display constructed according to a second embodiment of the present invention.

FIG. 3 illustrates a portion of a flat panel display 100 constructed in accordance with a second embodiment of the present invention. Flat panel display 100 is also fabricated from a glass plate 20 and a substrate 30. An additional mechanical supporting substrate 50 may also be used to strengthen the completed flat panel display 100. Elements, and their description thereof, of the flat panel display 100 which are similar to those in the above described display 10 (FIG. 1) have the same reference numerals. The manufacturing process of the display 100 will also be described in detail below.

The bottom surface of the glass plate 120 is coated with a conductive layer 124. The conductive layer 124 is used to carry away electrons from the ionized gas. Preferably, the conductive layer 124 is tin oxide and derivatives thereof. Derivatives of tin oxide, as used in this application, means compounds including tin, oxygen and other elements. It is worth noting that any material with similar characteristics as tin oxides, specifically, transparency and conductiveness, may be used as the conductive layer 124. In a preferred embodiment, indium tin oxide (ITO) is used as the conductive layer 124. An insulating layer 126, is deposited over the conductive layer 124 to prevent short circuits with the conductive traces 36 and 38. The insulating layer 126 should also be transparent. Preferably, the insulating layer 126 would be magnesium oxide. The insulating layer 126 could also be patterned to be excluded from the pits 40 and would therefore not need to be transparent.

The flat panel display 100 constructed according to the second embodiment of the invention operates as follows. The gas maintained within the pit 40 ionizes when a voltage is applied to the firing points 32, 34 through the conductive traces 36, 38. The mechanism driving the traces 36, 38 will be described below. Photons (not shown) from the ionized gas travel to the glass plate 20 forming a visual image on the flat panel display 100.

For a color image, colored filter elements (not shown) are deposited upon the glass plate 20. Similar to the phosphor dots 22 (FIG. 1), the colored filter elements are deposited along the glass plate 20, but can be on either the top or bottom surface, in a pattern of rows and columns containing numerous trios of red, blue and green dots. Each trio corresponding to one display pixel.

Referring now to FIG. 1, the process of manufacturing a flat panel display 10 in accordance with the first embodiment of the present invention is described as follows. The first step is to etch the pits 40 into the substrate 30. There must be one pit 40 for each phosphor dot 22 deposited on the glass plate 20. Accordingly, the pattern of the pits 40 to be etched into the substrate 30 must match the pattern of the phosphor dots 22 deposited on the glass plate 20. As stated above, the substrate 30 is preferably made of a single crystal silicon. Alternatively, amorphous silicon deposited on an underlying layer of glass, or another combination may be used as long as a material capable of being patterned and etched is present on the substrate 30. The thickness of the substrate 30 is approximately 28 mils (0.725 millimeters).

Figure 4A:
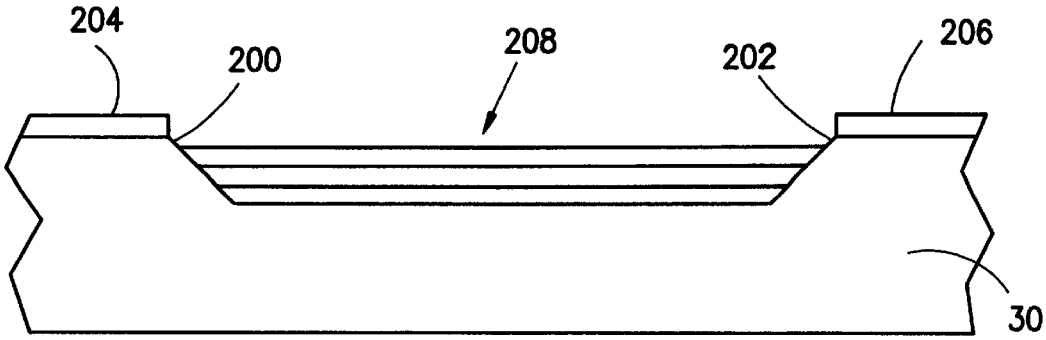
FIGS. 4*a*–4*d* are cross-sectional views of a portion of a flat panel display Constructed according to the first embodiment of the present invention during the manufacturing process.

Referring to FIG. 4*a*, the substrate 30 is initially etched at two points 200, 202 where the region represented by reference numeral 208 is removed during etching. Etching is performed by a well known wet etching technique using mixtures of potassium hydroxide (KOH) and isotropyl alcohol. These etchants will create precise V-shaped grooves in a silicon substrate. The edges of the grooves will be approximately 55 degrees from the surface. Masks 204, 206 are used to prevent areas of the substrate 30 that are not to be etched from being etched away. Conventional masking material, such as photoresist with an adhesion promoter similar to hexamethyldisilazane (HMDS), is used. Region 208 is removed during the etching process.

Figure 4B:
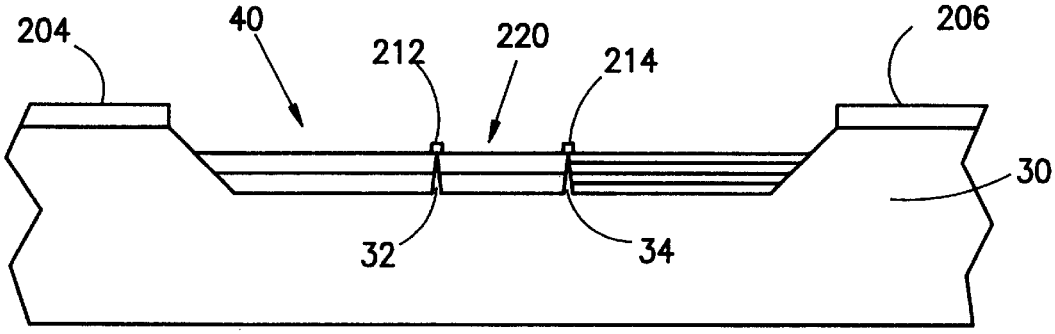
Figure 4C:
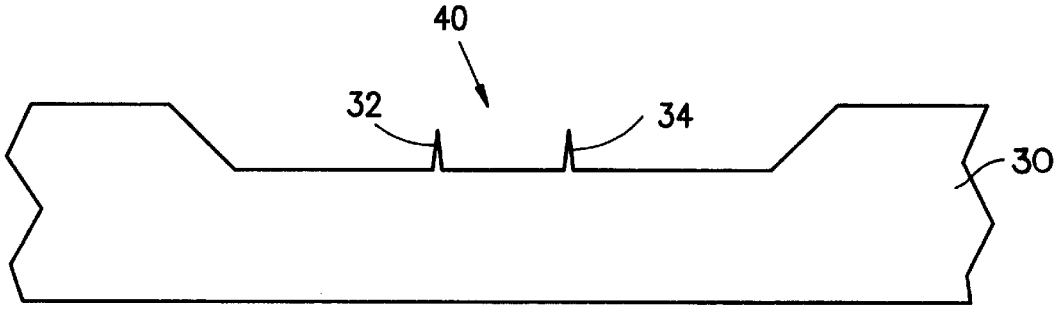

Referring to FIG. 4*b*, the etching of the pit 40 continues with the formation of the firing points 32, 34. The region denoted by reference numeral 220 is etched away by one etching cycle using the same etchant and masking material as described above forming the firing points 32, 34. Briefly, the firing points 32, 34 are created by placing masks 212, 214 over the regions where the firing points 32, 34 are to be formed and applying the etchant to the pit 40. During the etching, region 220 is removed, forming the two firing tips 32, 34 (FIG. 4*c*) and the completed pit 40.

Figure 4D:
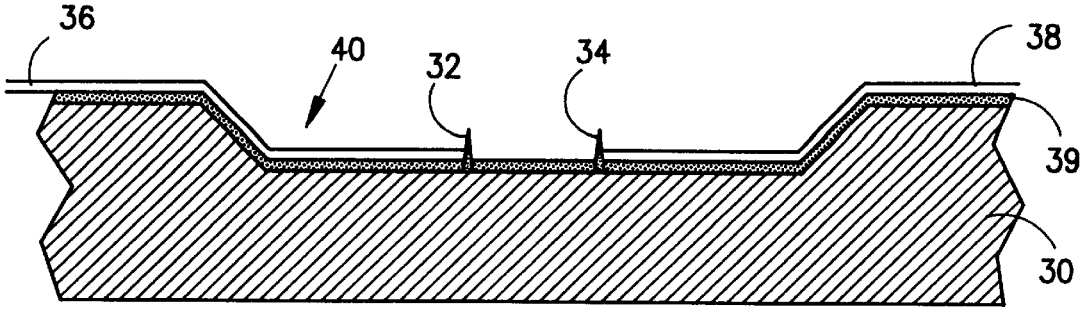

FIG. 4*d* illustrates the formation of the conductive traces 36, 38. Initially, the substrate 30 is coated with an insulating material 39, such as zirconium, magnesium oxide, glass or oxide deposited or grown. The traces 36, 38 are formed by sputtering a conductive material onto the substrate 30, after the insulating material 39 has been applied to the substrate 30. The conductive traces 36, 38 are patterned such that each trace has one end connected to a firing tip and a second end connected to an edge of the substrate 30 or to the electronic circuitry present on substrate 30. Once the conductive traces 36, 38 are formed, the substrate 30 is complete. Any trimming or cutting of the substrate 30 to match the desired features of the flat panel display 10 can now occur. It must be noted that the process for creating the completed substrate 30 is not limited to the above illustrative examples as many process modifications can be made to produce the completed display panel.

Referring again to FIG. 1, another step in the manufacturing of the display 10 is to deposit the phosphor dots 22 on the bottom surface of the glass plate 20. The pattern of the phosphor dots 22 to be deposited on the glass plate 20 must match the pattern of the pits 40 etched into the substrate 30. If the display 10 is to be in color, then the pattern of the trio of light-generating phosphor dots 22 must also correspond to the pattern of the pits 40. The thickness of the glass plate 20 can range from between 10 to 20 millimeters.

The glass plate 20 is aligned with and then mated to the substrate 30 once all of the phosphor dots 22 are deposited on glass plate 20. Any suitable and well known bonding technique may be used. The mating of the glass plate 20 to the substrate 30 traps air within the pits 40. If a gas other then air is to be used, that gas must be placed in the pits 40. The manufacturing of the flat panel display 10 is now completed.

An additional mechanical supporting substrate 50 may also be mounted to the rear surface of the substrate 30 to strengthen the completed flat panel display 10. The thickness of the supporting substrate 50 is related to the thickness of the glass plate 20 and the fragility of the substrate 30. For example, if the glass plate 20 is relatively thick (for example, 30 millimeters), then the supporting substrate 50 can be thin since the thickness of the glass plate 20 along with the thickness of the substrate 30 (approximately 28 mils) is sufficient to prevent warping of the display 10. On the other hand, for example, a thin glass plate (10 millimeters) and a fragile substrate 30 would require a thicker supporting substrate 50 to prevent warping of the display 10.

Referring now to FIG. 3, the process for manufacturing a flat panel display 100 constructed in accordance with the second embodiment of the present invention will now be discussed. The pits 40, the points 32, 34 and the traces 36, 38 of the substrate 30 are created in the same manner as described above for the first embodiment.

Formation of the glass plate 20 is altered from above in that the phosphor dots 22 are replaced by colored filter elements. The colored filter elements are patterned in the same fashion as the phosphor dots 22 and can reside on either the top or bottom surface of the glass plate 20. In addition, the bottom surface of the glass plate 120 is coated with a conductive layer 124 (as shown in FIG. 3). Preferably, the conductive layer 124 is tin oxide. It is worth noting that any material with similar characteristics as tin oxides, such as transparency and conductiveness, may be used as the conductive layer 124. In a preferred embodiment, indium tin oxide (ITO) is used as the conductive layer 124. An insulating layer 126, is deposited over the conductive layer 124 to prevent short circuits with the conductive traces 36 and 38. The insulating layer 126 should also be transparent. Preferably, the insulating layer 126 would be magnesium oxide. The insulating layer 126 could lso be patterned to be excluded from the pits 40 and would therefore not need to be transparent. The glass plate 20 is mated with the substrate 30 and supporting substrate 50 as described above with respect to the first embodiment.

Numerous adaptations and modifications will be readily apparent to one skilled in the art without departing from the scope of this invention. For example, different gasses, such as neon, argon, or helium could be used instead of air. In addition, a glass plate 20 made out of layers of glass material could contain the colored filter elements inside the glass plate 20. Additionally, the phosphor dots 22, and filters, may be arranged in a different pattern (not solely row and column). Substitutes for the conductive and insulating layers 124, 126 may also be used. As stated earlier, each pit 40 can contain more than two firing points 32, 34.

Figure 5:
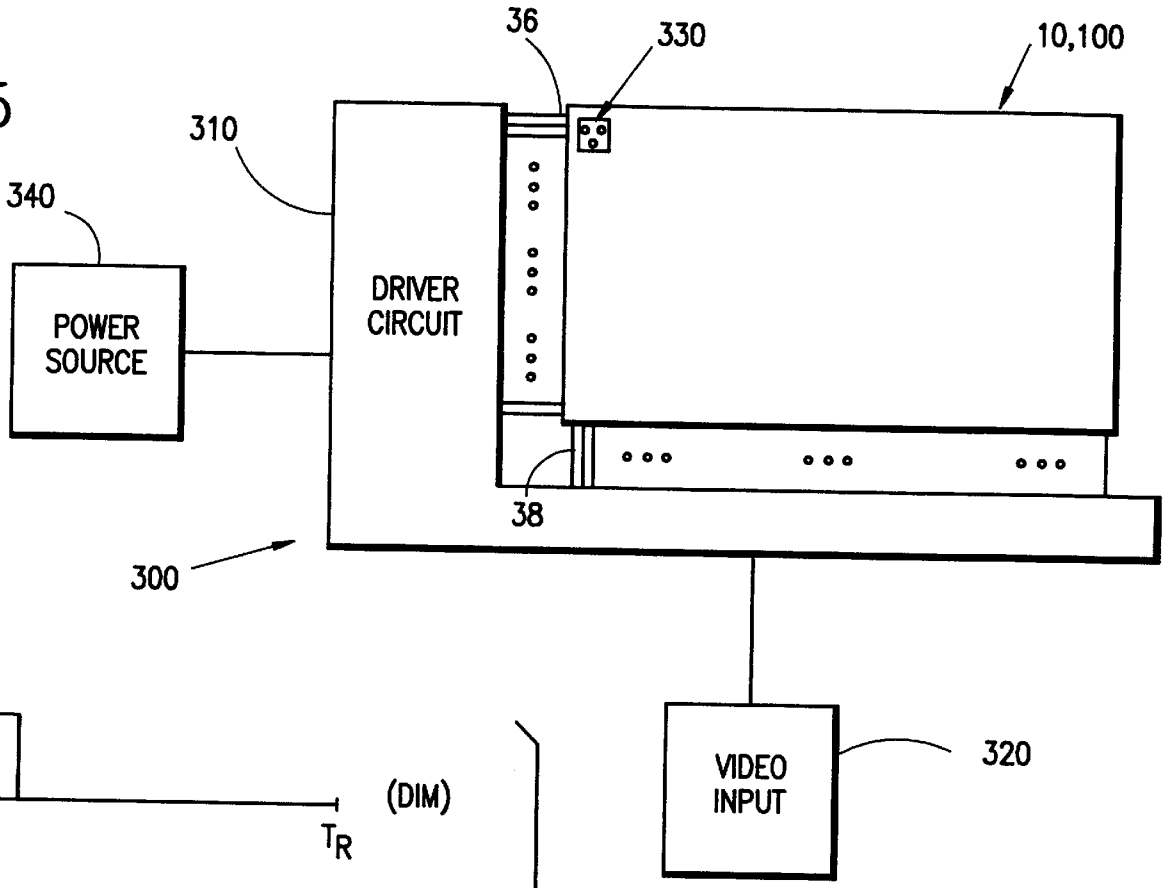
FIG. 5 is a block diagram of a video device utilizing a flat panel display constructed according to an embodiment of the present invention.

Referring now to FIG. 5, the operation of the flat panel displays 10, 100 is described as follows. A video device 300 includes a flat panel display 10, 100 constructed in accordance with one of the embodiments of the present invention, a driver circuit 310, a video input 320, and a power source 340. The display 10, 100 is shown as a color display having a display pixel 330. The display 10, 100 would have many display pixels 330 arranged in rows and columns encompassing the entire surface area of the display 10, 100. The display pixels 330 are comprised of a trio of light generating phosphors (for display 10) or colored filter elements (for display 100) which shall hereinafter be referred to as colored cells 330*r*, 330*g*, 330*b*. Colored cell 330*r* generates red light, cell 330*b* generates blue light, and cell 330*g* generates green light.

Numerous pairs of conductive traces 36, 38, each pair corresponding to one of the cells 330*r*, 330*b*, 330*g* of a display pixel 330, are illustrated as extending from the edge of the display 10, 100. The traces 36, 38 are connected to the driver circuit 310. The driver circuit 310 is connected to the power source 340 and the video input 320. The power source 340 supplies the necessary energy to energize the cells 330*r*, 330*b*, 330*g* in response to a video display signal.

The driver circuit 310 receives video data from the video input 320. The video input 320 contains display pixel information such as pixel identification (generally referred to as an address) and intensity. If a color display is used, the video input would 320 would contain color information and intensity levels for each color within the pixel. Intensity information generally ranges between a bright color and a dim color. A value, 0 for example, would be assigned to the dimmest intensity while another value, 15 for example, would be assigned to the brightest intensity. Values between the brightest and dimmest values could be assigned as intensities having increasing brightness (up to the brightest intensity).

The driver circuit 310 proceeds to drive the display 10, 100 by supplying the firing voltage across the conductive traces 36, 38 (connected to the cells 330*r*, 330*b*, 330*g*) corresponding to the "address" of the pixel information contained within the video input 320.

The video device 300 can utilize any conventional driver circuit 310 to perform the addressing of the cells 330*r*, 330*b*, 330*g* of each pixel 330 of the displays 10, 100. Typical addressing schemes use a row and column approach, wherein each cell 330*r*, 330*b*, 330*g* has a corresponding row and column number (address) and the cell 330*r*, 330*b*, 330*g* is driven by supplying the requisite voltage to that row and column. Accordingly, the first set of conductive traces 36 may be organized as rows while the second set of traces 38 may be columns, or vice versa.

Typical drivers will drive the displays 10, 100 at a predetermined rate, for example 60 times per second, so that a steady video image may be perceived by the human eye. This will be referred to as the refresh rate.

The flat panel displays 10, 100 of the video device 300 may be driven by analog or digital methods. For example, the display driving operation can be performed in a continuous analog control mode. In this mode, intensity is directly related to the magnitude of an applied analog voltage. That is, there is a range of voltage levels between the voltage level for a dim cell 330*r*, 330*b*, 330*g* and the voltage level for a bright cell 330*r*, 330*b*, 330*g*. The driver receives the information and drives the display 10, 100 accordingly. The cells 330*r*, 330*b*, 330*g* are driven due to the persistence of the phosphors (for display 10) or the gas (for display 100) and is refreshed continuously at a predetermined rate by the driver 310. Intensity is maintained by re-driving the same cells 330*r*, 330*b*, 330*g* at the predetermined refresh rate until the video input 320 indicates that the pixel 330 should have its intensity changed. Since the display information is read out of digital memory, this mode would require additional digital to analog circuitry to convert the digital information to the corresponding analog voltage signal.

In a preferred embodiment, the operation of the flat panel displays 10, 100 in the video device 300 is performed in a digital pulsed mode. Intensity information is used to define the duty cycle of corresponding firing voltage pulses (as described below). The pulse is short and set to a constant voltage level for an "on" condition whereas no pulse is generated for an "off" condition. Unlike the analog mode, its the frequency of these "on" firing voltage pulses that controls the intensity, and not the voltage levels.

Figure 6:
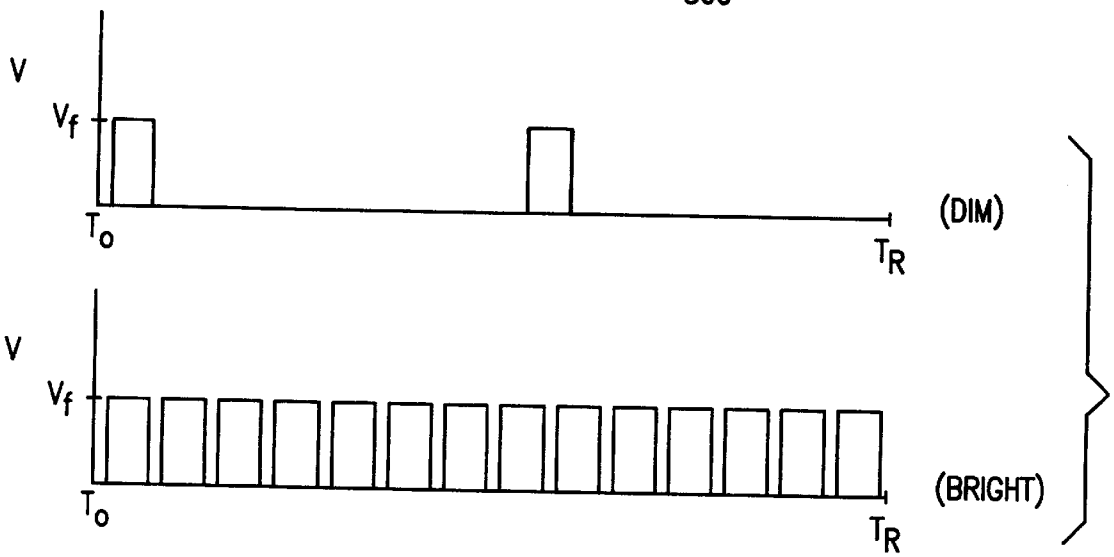
FIG. 6 is an illustration of pixel intensity under a digital pulse control mode of a flat panel display constructed in accordance with a preferred embodiment of the present invention.

Referring now to FIG. 6, by using short firing voltage pulses (Vf), the intensity of the cells 330*r*, 330*b*, 330*g*, can be controlled by the duty cycle of the pulses. That is, photon activity can be increased or decreased, and thereby control intensity of the cells 330*r*, 330*b*, 330*g*. For example, when the short pulses are spaced apart in time, photon activity decreases causing the cells 330*r*, 330*b*, 330*g* of a pixel 330 to appear dim. When the short pulses are spaced close in time, photon activity increases causing the cells 330*r*, 330*b*, 330*g* of a pixel 330 to appear bright. The duty cycle and the intensity rates can be any suitable rate that is determined to provide sufficient pixel intensity. Since the display information is received in a digital format, the digital pulsed method does not require additional digital to analog conversion circuitry. Therefore, the pulsed mode of operation reduces circuitry of the video device 300.

In a preferred embodiment, the driver circuit 310 is integrated within the substrate 30. For example, the circuitry of the driver circuit 310 can be patterned and etched into the back surface of the substrate 30 while the pits 40 are patterned and etched into the front surface of the substrate 30. Alternatively, the circuitry can be embedded around the display area of the display 10 outside the display area. In either case, the conductive traces 36, 38 are connected to the driver circuit 310. The need for external driver circuit 310 components and enclosures is disposed with.

Figure 7:
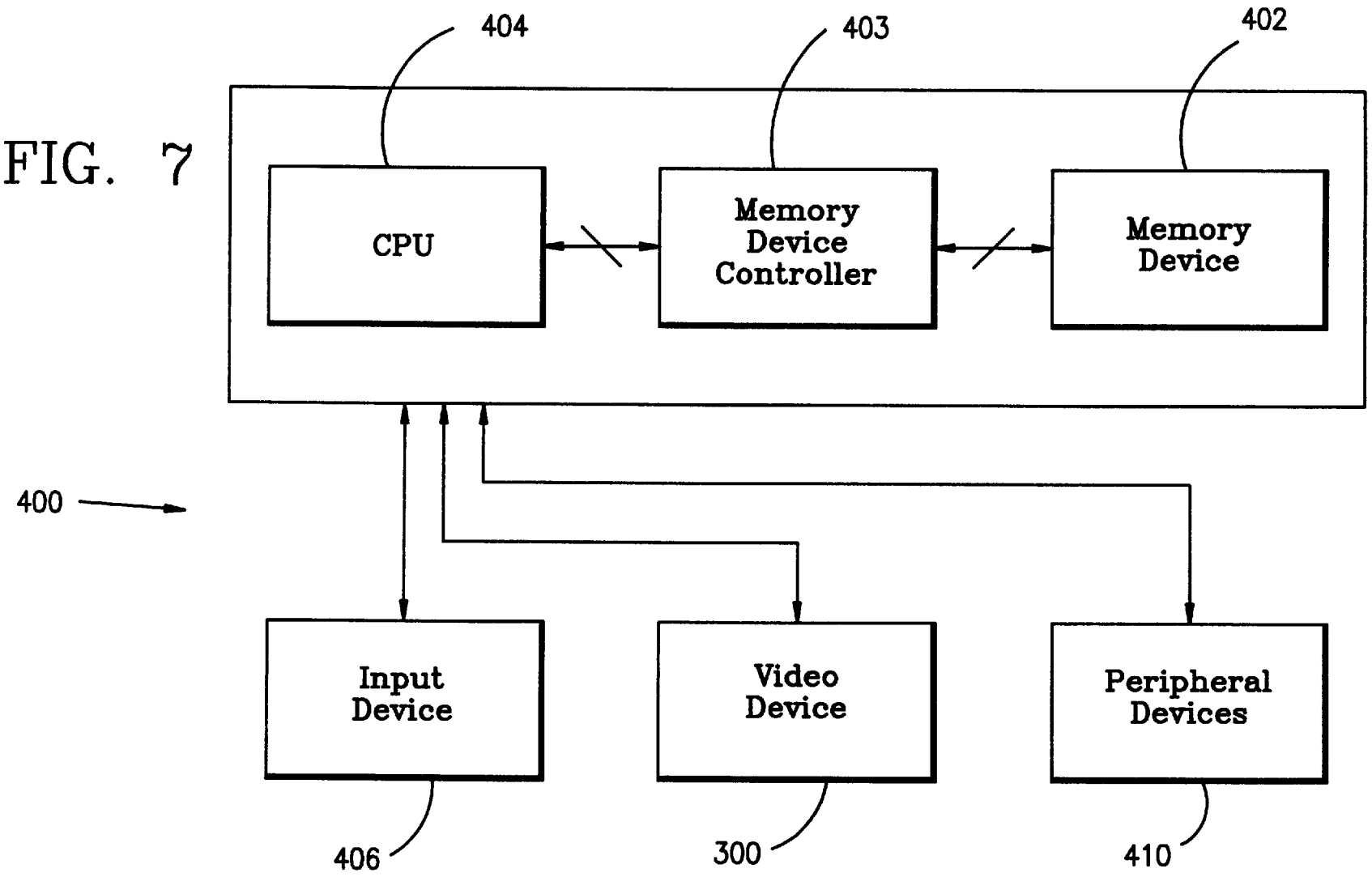
FIG. 7 is a block diagram of a computer system incorporating the video device of FIG. 5.

Referring now to FIG. 7, the video device 300 constructed in accordance with the present invention is incorporated into a computer system 400. A computer system 400 is exemplary of a device having a video device 300. The computer system 400 generally comprises a video device 300, a memory device 402, a memory device controller 403, a central processing unit (CPU) 404, an input device 406, and/or peripheral devices 410. The video device 300 is used to display information, as described above, processed or received by the computer system 400.

While the invention has been described in detail in connection with the preferred embodiments known at the time, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention.

What is claimed as new and desired to be protected by Letters Patent of the United States is:

1. A method of producing a flat panel display, comprising the steps of:

providing a first substrate;

forming a plurality of pits within said first substrate;

forming at least two upstanding firing points within each of said plurality of pits;

providing an insulating layer on said first substrate;

providing conductive traces to each of said firing points, said conductive layer placed on said insulating layer on said first substrate;

mounting said first substrate to a second light transmissive substrate and covering said pits with said second substrate; and trapping a gas at or near atmospheric pressure within said pits.

2. The method according to claim 1, wherein the gas is air.

3. The method according to claim 1, wherein the gas is neon.

4. The method according to claim 1, wherein the gas is helium.

5. The method according to claim 1, wherein the gas is argon.

6. The method according to claim 1, wherein said second substrate is glass having a first surface and a second surface, the second surface of said glass being in contact with said first substrate when said glass is mounted to said first substrate, the method including the further step of providing regions of phosphor on the second surface of said glass prior to mounting said glass on said first substrate, said regions of phosphor being aligned with said pits.

7. The method according to claim 1, wherein said firing points are formed from said first substrate.

8. The method according to claim 7, wherein said firing points are spaced in the range of approximately 10 to 25 microns thirteen microns apart.

9. The method according to claim 8 wherein said firing points are spaced approximately 13 microns apart.

10. The method according to claim 8, wherein said firing points are very sharp and have a height in the range of approximately 2 to 7 microns.

11. The method according to claim 10 wherein said firing points have a height of approximately 5 microns.

12. The method according to claim 1, wherein said second substrate is glass having a first surface and a second surface, the method including the further steps of:

providing a conductive layer on the second surface of said glass prior to mounting said glass on said first substrate; and providing a second insulating layer on the second surface of said glass prior to mounting said glass on said first substrate, said second insulating layer being placed on said conductive layer, said second insulating layer being in contact with said first substrate when said glass is mounted to said first substrate.

13. The method according to claim 12, further comprising the step of providing colored filter elements on the second surface of said glass, said filter elements being aligned with said pits.

14. The method according to claim 12, further comprising the step of providing colored filter elements on the first surface of said glass, said filter elements being aligned with said pits.

15. The method according to claim 1, wherein said second substrate is a glass substrate comprised of two layers of glass, said glass substrate having a first outer surface and a second outer surface, said glass substrate having an inner surface formed between the two layers of glass, the method including the further steps of:

providing a conductive layer on the second outer surface of said glass substrate prior to mounting said glass substrate on said first substrate;

providing a second insulating layer on the second surface of said glass substrate prior to mounting said glass substrate on said first substrate, said second insulating layer being placed on said conductive layer, said second insulating layer being in contact with said first substrate when said glass is mounted to said first substrate; and providing colored filter elements on the inner surface of said glass, said filter elements being aligned with said pits.

16. A method of producing a flat panel display capable of displaying colored images, comprising the steps of:

providing a silicon substrate;

forming a plurality of pits within said silicon substrate;

forming at least two upstanding firing points within each of said plurality of pits, said firing points being etched out of said silicon substrate;

providing an insulating layer on said substrate;

providing conductive traces to each of said firing points, said conductive traces placed on said insulating layer on said silicon substrate;

providing a glass substrate having a first surface and a second surface;

providing regions of color generating phosphor selected from the group of red, blue and green color generating phosphors on the second surface of said glass substrate;

mounting said silicon substrate to said glass substrate such that the second surface of said glass substrate is in contact with said silicon substrate and said regions of color generating phosphor are in alignment with said pits; and trapping a gas at or near atmospheric pressure within said pits.

17. The method according to claim 16, wherein the gas is air.

18. A method of producing a colored flat panel display, comprising the steps of:

providing a silicon substrate;

forming a plurality of pits within said silicon substrate;

forming at least two upstanding firing points within each of said plurality of pits, said firing points being etched out of said silicon substrate;

providing conductive traces to each of said firing points, said conductive traces placed on said insulating layer on said silicon substrate;

providing an insulating layer on said substrate;

providing a glass substrate having a first surface and a second surface;

providing a conductive layer on the second surface of said glass;

providing a second insulating layer on the second surface of said glass, said second insulating layer being placed on said conductive layer;

providing colored filter elements selected from the group of red, blue and green colored filter elements on the second surface of said glass;

mounting said silicon substrate to said glass substrate such that said second insulating layer is in contact with said silicon substrate and said colored filter elements are in alignment with said pits; and trapping a gas at or near atmospheric pressure within said pits.

19. The method according to claim 18 wherein the gas is air.

20. A flat panel display comprising:

a first substrate, said first substrate having a plurality of pits formed therein, said plurality of pits each having at least two upstanding firing points formed therein;

a plurality of conductive traces deposited on an insulating layer provided on said first substrate, each of said plurality of conductive traces corresponding to and connected to one of said firing points;

a second substrate mated to said first substrate, said second substrate covering said pits; and a gas trapped at or near atmospheric pressure within said pits.

21. The flat panel display according to claim 20, wherein the gas is air.

22. The flat panel display according to claim 20, wherein said second substrate is glass having a first surface and a second surface, the second surface of said glass being in contact with said first substrate when said glass is mounted to said first substrate, the first surface of said glass having regions of phosphor deposited therein, said regions of phosphor being in alignment with said pits.

23. The flat panel display according to claim 20, wherein said first substrate is a silicon substrate.

24. The flat panel display according to claim 23 wherein said firing points are spaced approximately 10 to 25 microns apart.

25. The flat panel display according to claim 24 wherein said firing points are spared approximately 13 microns apart.

26. The flat panel display according to claim 23, wherein said firing points are pointed and have a height of 2 to 7 microns.

27. The flat panel display according to claim 26 wherein said firing points have a height of approximately 5 microns.

28. The flat panel display according to claim 20, wherein said second substrate is glass having a first surface and a second surface, the second surface of said glass having a conductive layer deposited thereon and a second insulating layer deposited on said conductive layer, the second insulating layer on said second surface of said glass being in contact with said first substrate when said glass is mounted to said first substrate.

29. The flat panel display according to claim 28, wherein colored filter elements are deposited on the first surface of said glass, said filter elements being aligned with said pits.

30. A flat panel color display comprising:

a silicon substrate, said silicon substrate having a plurality of pits etched therein, said plurality of pits containing at least two upstanding firing points;

a plurality of conductive traces deposited on an insulating layer provided on said silicon substrate, each of said plurality of conductive traces corresponding to and connected to one of said firing points;

a glass plate mated to said silicon substrate, said glass plate covering said pits, said glass plate having a first surface and a second surface, the second surface of said glass plate being in contact with said silicon substrate, the second surface of said glass plate having regions of color generating phosphor deposited thereon, said regions of color generating phosphor being in alignment with said pits; and a gas trapped at or near atmospheric pressure within said pits.

31. The flat panel color display according to claim 30 wherein the gas is air.

32. The flat panel color display according to claim 27 wherein said firing points are spaced approximately 10 to 25 microns apart.

33. The flat panel color display according to claim 32 wherein said firing points are spaced approximately 13 microns apart.

34. The flat panel color display according to claim 32, wherein said firing points are pointed and have a height of approximately 2 to 7 microns.

35. The flat panel color display according to claim 34 wherein said firing points have a height of approximately 5 microns.

36. A flat panel display capable of displaying colored images, comprising:

a silicon substrate, said silicon substrate having a plurality of pits etched therein, said plurality of pits containing at least two upstanding firing points etched therein;

a plurality of conductive traces deposited on an insulating layer provided on said silicon substrate, each of said plurality of conductive traces corresponding and connected to one of said firing points;

a glass plate mated to said silicon substrate, said glass plate covering said pits, said glass plate having a first surface and a second surface, the second surface of said glass plates having a conductive layer deposited thereon and a second insulating layer deposited on said conductive layer, the second insulating layer being in contact with said silicon substrate, and colored filter elements deposited on said glass, said filter elements being aligned with said pits; and a gas trapped at or near atmospheric pressure within said pits.

37. The flat panel display of claim 36 wherein the gas is air.

38. The flat panel display according to claim 36, wherein said firing points are spaced approximately 10 to 25 microns apart.

39. The flat panel display according to claim 38 wherein said firing points are spaced approximately 13 microns apart.

40. The flat panel display according to claim 38 wherein said firing points are pointed and have a height of approximately 2 to 7 microns.

41. The flat panel display according to claim 40 wherein said firing points have a height of approximately 5 microns.

42. The flat panel display according to claim 36 wherein the colored filter elements are deposited on the first surface of said glass.

43. The flat panel display according to claim 36 wherein the colored filter elements are deposited on the second surface of said glass.

44. A display device comprising:

a power source;

a video input;

a silicon substrate, said silicon substrate having a plurality of pits etched therein, said plurality of pits containing at least two upstanding firing points etched therein;

a plurality of conductive traces deposited on an insulating layer provided on said silicon substrate, said conductive traces having a first and second end, the first end of each of said plurality of conductive traces being connected to one of said firing points;

a glass plate mated to said silicon substrate, said glass plate covering said pits, said glass plate having a first surface and a second surface, the second surface of said glass plate being in contact with said silicon substrate, the second surface of said glass plate having regions of phosphor deposited therein, said regions of phosphor being in alignment with said pits;

a gas trapped at or near atmospheric pressure within said pits; and a video driver connected to said power source, said video input, and the second end of said plurality of conductive traces, said video driver receiving display information from said video input and outputting a firing voltage to said conductive traces corresponding to the display information.

45. The display device of claim 44 wherein the gas is air.

46. The display device according to claim 44 wherein said firing points are spaced approximately 13 microns apart.

47. The display device according to claim 46, wherein said firing points are pointed and have a height of approximately 5 microns.

48. The display device according to claim 44 wherein said video driver outputs the firing voltage in a pulsed mode.

49. The display device according to claim 48 wherein an intensity level of the display information is controlled by a duty cycle of the firing voltage.

50. The display device according claim 44 wherein the driver is formed within said silicon substrate.

51. The display device according to claim 44 wherein the driver is formed on a first side of said silicon substrate.

52. The display device according to claim 44 wherein the driver is formed on a second side of said silicon substrate.

53. A display device comprising:

a power source;

a video input;

a silicon substrate, said silicon substrate having a plurality of pits etched therein, said plurality of pits containing at least two firing points etched therein;

a plurality of conductive traces deposited on an insulating layer provides on said silicon substrate, said conductive traces having a first and second end, the first end of each of said pluraLity of conductive traces being connected to one of said firing points;

a glass plate mated to said silicon substrate, said glass plate covering said pits, said glass plate having a first surface and a second surface, a conductive layer is deposited on the second surface of said glass plate, a second insulating layer is deposited on the second surface of said glass and is placed on said conductive layer, said second insulating layer being in contact with said silicon substrate when said glass plate is mated to said silicon substrate, and colored filter elements are deposited on the first surface of said glass plate, said filter elements being in alignment with said pits;

a gas trapped at or near atmospheric pressure within said pits; and a video driver connected to said power source, said video input, and the second end of said plurality of conductive traces, said video driver receiving display information from said video input and outputting a firing voltage to said conductive traces corresponding to the display information.

54. The display device of claim 53 wherein the gas is air.

55. The display device according to claim 53 wherein said firing points are spaced approximately 13 microns apart.

56. The display device according to claim 55, wherein said firing points are pointed and have a height of approximately 5 microns.

57. The display device according to claim 56 wherein said video driver outputs the firing voltage in a pulsed mode.

58. The display device according to claim 57 wherein an intensity level of the display information is controlled by a duty cycle of the firing voltage.

59. The display device according to claim 53 wherein the driver is formed within said silicon substrate.

60. The display device according to claim 53 wherein the driver is formed on a first side of said silicon substrate.

61. The display device according to claim 53 wherein the driver is formed on a second side of said silicon substrate.

62. A computer system comprising:

an input device;

a memory device;

a memory device controller connected to said memory device;

a processor connected to said memory device controller and said input device; and a display device connected to said processor, said display device comprising:

a power source;

a video input;

a first substrate, said first substrate having a plurality of pits formed therein, said plurality of pits containing at least two upstanding firing points formed therein;

a plurality of conductive traces deposited on an insulating layer provided on said first substrate, said conductive traces having a first and second end, the first end of each of said plurality of conductive traces being connected to one of said firing points;

a glass plate connected to said first substrate, said glass plate covering said pits, said glass plate having a first surface and a second surface, the second surface of said glass plate being in contact with said first substrate, the second surface of said glass plate having regions of phosphor deposited thereon, said regions of phosphor being in alignment with said pits;

a gas trapped at or near atmospheric pressure within said pits; and a video driver connected to said power source, said video input, and the second end of said plurality of conductive traces, said video driver receiving display information from said video input and outputting a firing voltage to said conductive traces corresponding to the display information.

63. The computer system according to claim 62 wherein the gas is air.

64. The computer system according to claim 62 wherein said first substrate is silicon.

65. The computer system according to claim 64 wherein said firing points are formed from said first substrate.

66. The computer system according to claim 65 wherein said firing points are spaced approximately 13 microns apart.

67. The computer system according to claim 66 wherein said firing points are pointed and have a height of approximately five microns.

68. The computer system according to claim 62 wherein said video driver outputs the firing voltage in a pulsed mode.

69. The computer system according to claim 68 wherein an intensity level of the display information is controlled by a duty cycle of the firing voltage.

70. The computer system according to claim 62 wherein the driver is formed within said first substrate.

71. The computer system according to claim 62 wherein the driver is formed on a first side of said first substrate.

72. The computer system according to claim 62 wherein the driver is formed on a second side of said first substrate.

73. A computer system comprising:

an input device;

a memory device;

a memory device controller connected to said memory device;

a processor connected to said memory device controller and said input device; and a display device connected to said processor, said display device comprising:

a power source;

a video input;

a first substrate, said first substrate having a plurality of pits formed therein, said plurality of pits containing at least two upstanding firing points formed therein;

a plurality of conductive traces deposited on an insulating layer provided on said first substrate, said conductive traces having a first and second end, the first end of each of said plurality of conductive traces being to one of said firing points;

a glass plate connected to said first substrate, said glass plate covering said pits, said glass plate having a first surface and a second surface, a conductive layer deposited on the second surface of said glass plate, a second insulating layer is deposited on said second surface of said glass plate and placed on said conductive layer, said second insulating layer being in contact with said first substrate after said glass plate is connected to said first substrate, and colored filter elements are deposited on the first surface of said glass plate, said filter elements being in alignment with said pits, a gas trapped at or near atmospheric pressure within said pits; and a video driver connected to said power source, said video input, and the second end of said plurality of conductive traces, said video driver receiving display information from said video input and outputting a firing voltage to said conductive traces corresponding to the display information.

74. The computer system according to claim 73 wherein the gas is air.

75. The computer system according to claim 73 wherein said first substrate is silicon.

76. The computer system according to claim 75 wherein said firing points are formed from said first substrate.

77. The computer system according to claim 76 wherein said firing points are spaced approximately 13 microns apart.

78. The computer system according to claim 77 wherein said firing points are pointed and have a height of approximately five microns.

79. The computer system according to claim 73 wherein said video driver outputs the firing voltage in a pulsed mode.

80. The computer system according to claim 79 wherein an intensity level of the display information is controlled by a duty cycle of the firing voltage.

81. The computer system according to claim 73 wherein the driver is formed within said first substrate.

82. The computer system according to claim 73 wherein the driver is formed on a first side of said first substrate.

83. The computer system according to claim 73 wherein the driver is formed on a second side of said first substrate.

* * * * *